United States Patent [19]

Brochman

[11] 4,448,326

[45] May 15, 1984

[54] EASY OPENING TAPE CLOSURE FOR BEVERAGE CONTAINER

[75] Inventor: Wilfred R. Brochman, Oakdale, Minn.

[73] Assignee: Minnesota Mining and Manufacturing Company, St. Paul, Minn.

[21] Appl. No.: 438,304

[22] Filed: Nov. 1, 1982

[51] Int. Cl.[3] ..... B65D 17/34

[52] U.S. Cl. ..... 220/270; 206/628; 206/634; 220/94 R

[58] Field of Search ..... 220/270, 94 A, 94 R; 206/628, 634

[56] References Cited

U.S. PATENT DOCUMENTS

| | | | |
|---|---|---|---|
| 135,819 | 2/1873 | Atkinson et al. | 206/628 |
| 389,954 | 9/1888 | Cheswright | 206/628 |
| 2,499,528 | 3/1950 | Reitzes | 206/628 |

*Primary Examiner*—Joseph Man-Fu Moy

*Attorney, Agent, or Firm*—Donald M. Sell; James A. Smith; John C. Barnes

[57] ABSTRACT

A closure described having a tab end which is formed with punctures and projections surrounding those punctures which have been formed by fracturing the tape. The projections extend from opposite surfaces of the tape near adjacent punctures.

9 Claims, 4 Drawing Figures

EASY OPENING TAPE CLOSURE FOR BEVERAGE CONTAINER

This invention relates to easy opening closures for can ends of beverage containers, and one aspect of this invention is an improvement in the film for use with closures to permit an end of the same to be more securely grasped to remove the film for opening or closing.

BACKGROUND OF THE INVENTION

Easy opening closures for can ends utilizing tapes which are positioned over a pour opening and secured to the surface of the can end surrounding the pour opening are known in the art. Examples of such closures are shown in U.S.A. Pat. Nos. 3,389,827 issued to Abere et al; 4,108,330 issued to Patterson; 4,135,637 issued to Hannula; and 4,215,791 issued to Brochman.

These closures have utilized a tab on one end which the user is to grasp to peel the tape from the surface of the can to open the pour opening. To permit the operator to more securely grasp the tape a hole has been provided which is punched in the tape to provide a ring pull for the user. Other closures have utilized a broad tab which has been provided with embossments to give an irregular surface to the sides of the tape such that the operator could more easily grasp the surfaces of the normally smooth tape at the free end to peel the tape from the can end. Such embossed surfaces or irregular surfaces have been satisfactory when the tape surfaces are dry. Difficulty occurs however when the beverage can having the tape closure is in a container of ice water and the tape is wet when the user tends to grasp the tape to peel the closure free of the can end to open the pour opening.

It is thus an object of the present invention to improve the irregular surface in the tape to make the same more readily grasped such that even with wet or greasy fingers and whether the tape is wet or greasy the coefficient of friction of the free end of the tape will be sufficient that the user may readily retain a grasp on the tape to peel the same from the can end.

SUMMARY OF THE INVENTION

The present invention relates to an improved easy opening tape closure for a can end to permit removal of the tape from the pour opening such that the contents may be readily removed. The tape closure of the present invention comprises a tape adhered around the pour opening in the can end. The tape is adhered to the surface of the can and has a free end portion or tab which may be grasped by the user. The tape forming the closure is preferably a tape having a backing the thickness of which is about 2 mil (50 micrometers) to about 7 mil (180 micrometers). The free end of the tape is formed with an array of punctures with the tape fractured around the punctures, which define projections around the punctures with the projections on adjacent punctures projecting in opposite directions from the plane of the tape. The punctures in the tape are made by an array of projecting cutting tools such as the sharpened drill bit ends or star bits which are directed to engage opposite surfaces of the tape in spaced locations, preferably 0.047 inch (1.19 mm) apart, to puncture the tape with the cutting edges of the bits fracturing the tape and forcing the fractured portions around the puncture to extend from the surface of the tape. A preferred size for the drill bit ends is 0.020 inch.

BRIEF DESCRIPTION OF THE DRAWING

The present invention will be more readily understood with reference to the accompanying drawing wherein.

DESCRIPTION OF THE PREFERRED EMBODIMENTS

Figure 1:
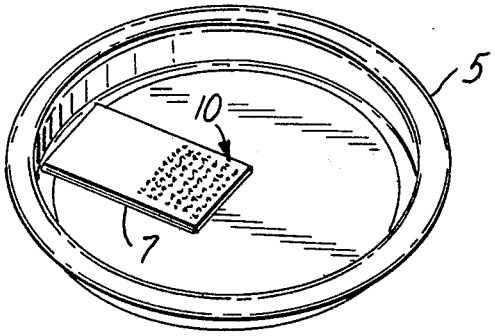
FIG. 1 is a perspective view of a can end having a tape closure constructed according to the present invention.
Figure 2:
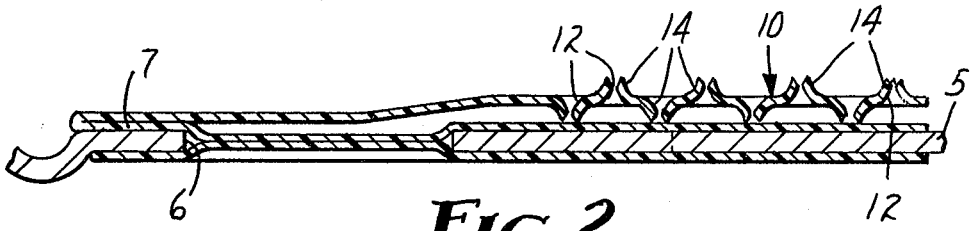
FIG. 2 is an enlarged detailed cross-sectional view of the can end and the tape closure of FIG. 1.

The present invention provides an improvement for easy opening closures for can ends where the closure is formed of a polymeric tape adhesively secured as by a thermoplastic adhesive to the surface of the can end around a pour opening. As illustrated in the drawing, a can end 5 is provided with an exterior surface and a pour opening 6 formed in said surface. An exterior sealing tape 7 is positioned over the pour opening and is adhered to the exterior surface of the can end around the pour opening. The tape is provided with a free end 10 which is to be grasped by the user and separated from the portion 7 of the tape, and as force is exerted, the tape portion 7 which is adhesively secured to the can end 5 around the pour opening 6 may be peeled from the can end to open the pour opening 6. This free end 10 of the tape has an array of punctures 12 formed therein. The punctures 12 are disposed in an array to provide a spacing between adjacent punctures. The tape is fractured as it is punctured. Surrounding each puncture is a plurality of projections 14, at least 3, which are formed due to a fracturing of the tape. The projections 14 extend from the surfaces of the free end of the tape 10 in opposite directions along adjacent punctures such that both surfaces of the tape have an increased coefficient of friction due to the projecting fractured tape portions. As the tape is fractured, the edges of the projections 14 are irregular and the projections maintain a position spaced slightly from each other, as indicated in FIG. 3, to expose said roughened irregular surfaces.

Figure 3:
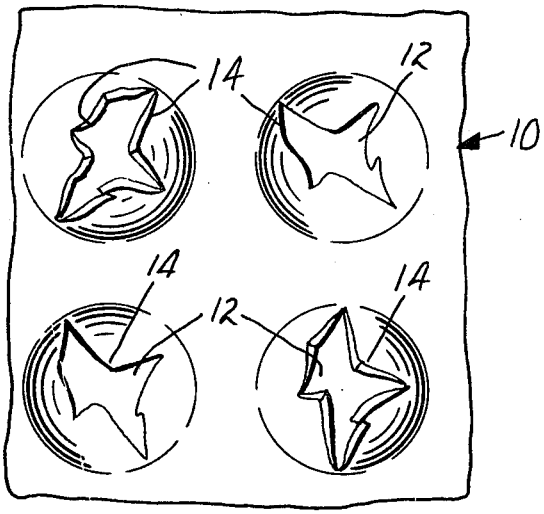
FIG. 3 is an enlarged detail plan view of a small portion of the free end of the tape shown in FIG. 2 showing one tape surface.

FIG. 3 shows the pattern and shows the projections 14 around the punctures in detail and the roughened edges of the projections in spaced relation with the roughened irregular fractured edges of the projections being exposed.

Figure 4:
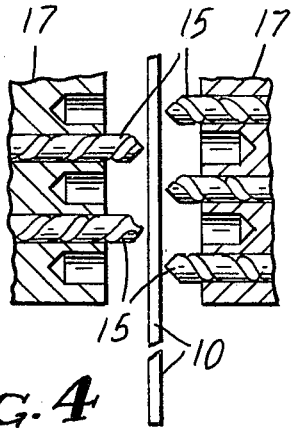
FIG. 4 is a fragmentary detail sectional view of the fixture illustrating an end row of tools used in puncturing the tape to form a closure according to the present invention.

The punctures are formed by engaging opposite sides of the free end of the tape with the sharpened free end of a cutting tool such as a drill bit 15 as illustrated in FIG. 4. The preferred size for the drill bit is 0.020 inch and for the films chosen may be between 0.018 to 0.035 inch diameter bits. The drill bits are secured in an array in support blocks 17 which are movable toward each other to drive the sharpened ends of the drill bits through the tape 10. The drill ends preferably are spaced, center to center, 0.09 inch (3/32 inch) apart to form punctures 0.047 inch apart and at least 0.09 inch (3/32 inch) from the edges of the tape. The bits preferably project from the support blocks a distance about two and one-half times their diameter. In the case of a 0.020 inch bit, the end projects 0.050 inch. The irregular surfaces on the projections 14 result from a fracture caused by the end of the drill bit 15 piercing the tape and the spiral cutting edges of the free end of the drill bit bursting through the tape causing the tape to fracture before the drill penetrates the tape. The same surface has been formed by a small star drill but can not be repeatedly formed by the use of a nail, pin or other readily available instrument.

The fractured tape end 10 provides an increase in the coefficient of friction of the tape sufficient to permit the user's fingers to grasp and remain grasped to the tape even if the fingers have been subjected to grease as from eating a piece of chicken, or, if the fingers are wet and the tape is wet, resulting from the retrieval of a can from a container of water.

The array of punctures and the precise shape of all of the projections and the fractured edges of course will vary depending upon the thickness of the film, and it is preferred that the film for the closure be a flexible film selected from the group consisting of polytetramethylene terephthalate, (e.g., using "Valox 303" resin from General Electric Corporation), polyamide derived from 6—6 nylon (e.g., usig "Zytel ST 810HS" resin from E. I. duPont deNemours Co.), physical blends of polytetramethylene terephthalate/polyethylene, physical blends of polytetramethylene terephthalate/phenoxy, glycol modified polyethylene terephthalate (e.g. using "Kodar 6763" resin from Eastman Chemical Products, Inc.), polyvinylchloride, polypropylene and films derived from a graft copolymer comprising acrylonitrile/-methylmethacrylate copolymer grafted onto an acrylonitrile/butadiene copolymer backbone (e.g. using "Barex" resin from Vistron Corporation. Other materials may include thin foil-film composites as described in U.S. Pat. No. (application Ser. No. 264,657) assigned to the assignee of this application and have a thickness of between 2 mils (50 micrometers) to about 7 mils (180 micrometers). A preferred material is a polycarbonate film backing (e.g., using "Merlon 700" resin from Mobay Corporation of Pittsburg, Pa.) of about 5 mils (130 micrometers) in thickness.

Other examples of closures where a strip of film is used to open a container or package is a tear strip, sealing strips and sealing tapes.

What is claimed is:

1. An easy opening closure for a container comprising a polymeric film having a free end portion to be grasped by the user, said free end portion having an array of punctures formed therein with each puncture being surrounded by a plurality of projections fractured from the tape with the projections projecting in opposite directions from adjacent punctures.

2. A closure according to claim 1 wherein said film is selected from the group consisting of polytetramethylene terephthalate, polyamide derived from 6—6 nylon, physical blends of polytetramethylene terephthalate/-polyethylene, physical blends of polytetramethylene terephthalate/phenoxy, polyvinylchloride, polypropylene glycol modified polyethylene/terephthalate, graft copolymers comprising acrylonitrile/methylmethacrylate copolymer grafted onto acrylonitrile/butadiene copolymer backbone, or polycarbonate.

3. A closure according to claim 2 wherein said film has a thickness of between about 2 mils and about 7 mils.

4. A closure according to claim 1 wherein said film has a thickness of about 5 mils.

5. An easy opening tape closure for a can end having a pour opening formed therein comprising a tape portion disposed over said pour opening and adhered to the surface of the can end about the pour opening, said tape having a free end portion to be grasped by the user, said free end portion having an array of punctures formed therein with each puncture being surrounded by a plurality of projections fractured from the tape, the projections projecting from the surface of the tape in opposite directions from adjacent punctures.

6. A tape closure according to claim 5 wherein said tape comprises a backing selected from the group consisting of polytetramethylene terephthalate, polyamide derived from 6—6 nylon, physical blends of polytetramethylene terephthalate/polyethylene, physical blends of polytetramethylene terephthalate/phenoxy, polyvinylchloride, polypropylene, glycol modified polyethylene/terephthalate, graft copolymers comprising acrylonitrile/methylmethacrylate copolymer grafted onto acrylonitrile/butadiene copolymer backbone, polycarbonate, or thin foil-film composites.

7. A tape closure according to claim 6 wherein said tape has a thickness of between about 2 mils and about 7 mils.

8. A tape closure according to claim 5 wherein said tape has a thickness of about 5 mils.

9. A tape closure according to claim 5 wherein the punctures are spaced 0.047 inch apart and at least 0.09 inch from an edge of the tape.

* * * * *